United States Patent [19]

Yamada et al.

[11] Patent Number: 4,939,548

[45] Date of Patent: Jul. 3, 1990

[54] IMAGE FORMING APPARATUS

[75] Inventors: Takanobu Yamada; Nobuyuki Kawai, both of Osaka, Japan

[73] Assignee: Minolta Camera Co., Ltd., Osaka, Japan

[21] Appl. No.: 329,975

[22] Filed: Mar. 29, 1989

[30] Foreign Application Priority Data

Apr. 1, 1988 [JP] Japan ..... 63-81973

[51] Int. Cl.[5] ..... G03G 15/01

[52] U.S. Cl. ..... 355/245; 355/326

[58] Field of Search ..... 355/245, 260, 326, 327; 118/645

[56] References Cited

U.S. PATENT DOCUMENTS 4,697,915 10/1987 Hayashi et al. ..... 355/327

FOREIGN PATENT DOCUMENTS 57-204566 12/1982 Japan .

57-204567 12/1982 Japan .

61-151577 7/1986 Japan .

*Primary Examiner*—Joan H. Pendegrass

*Attorney, Agent, or Firm*—Willian Brinks Olds Hofer Gilson & Lione

[57] ABSTRACT

In an image forming apparatus, a support member attachably and detachably supporting a plurality of developing units is provided for moving the developing units upwardly and downwardly or along a common circular orbit by vertical or rotative movement. A vertical movement support member balances with balancers, while a rotary support member has rotative balance by mutual position of each developing unit. A lock member for locking a support member at a desired position and a sensor for detecting the movement of the support member when unlocked are actuated for judging an unbalanced state of the support member by a detecting signal of the sensor.

21 Claims, 8 Drawing Sheets

IMAGE FORMING APPARATUS

BACKGROUND OF THE INVENTION

1. Technical Field of the Invention

The present invention relates to image forming apparatus provided with a plurality of developing units, and more particularly to an image forming apparatus which is designed for selectively using a plurality of developing units supported on a movable support member by moving or rotating the developing units for changeably positioning the developing units at a location of development mainly for use in color copying machines, color printers and the like.

2. Brief Description of Related Art

Japanese Published Patent Application TOKKAI SHO No. 61-151577 discloses an apparatus which is designed for changeably using a plurality of developing units by a movable support member in a rotary method.

Meanwhile, Japanese Published Patent Applications TOKKAI SHO Nos. 57-204566 and TOKKAI SHO 57-204567 disclose apparatuses which are designed for changeably using a plurality of developing units by a movable support member in an elevation method.

Generally, a color copying machine is designed for forming a colored image by using colored developers of four colors. Incidentally, a movable support member provided with a plurality of developing units weighs heavily and it becomes difficult to drive and control the movement of the support member because of its increased resistance for positioning at a predetermined location by successive drive. In order to solve the problem, it is desired to balance the movement without any resistance to whatever position the movable support member is moved.

In a rotary method movable support member, the movement is balanced by disposing a required number of developing units spaced apart on the same circle around the central line of rotation of the movable support member.

In an elevation method movable support member, the movement is balanced by providing a balancer which works with a force almost equivalent to the gross weight of the support member in the direction opposite to the weight of the movable support member.

However, each one of the developing units is temporarily removed for exchanges of developers, sealing materials and bearings or replaced with another developing unit thereby causing in some cases one to forget to mount the developing units. When a developing unit is left unmounted, in case of the rotary method movable support member, the movement is unbalanced with effect of large eccentric gravity when it is driven since the weight balance around the central line of its rotation is collapsed, while in the case of the elevation method movable support member, the movement of the movable support member is unbalanced since the weight balance with the balancer is collapsed.

Furthermore, in the case of the elevation method movable support member in which a spring type balancer is used, the balance of movement of the movable support member is collapsed since the effect of the balancer is gradually weakened because of its fatigue with the passage of time.

In any case, excessive burden is loaded on a driving means in proportion to the operational balance lowered. The movable support member fails to operate or it becomes hard to start operation because of the shortage of torque since the smallest possible capacity of motor is utilized in view of manufacturing cost and advantageous operational control for the driving means. In the worst case, it causes to damage the cogs of a gear.

The Japanese Published Patent Application TOKKAI SHO No. 61-151577 discloses an apparatus which is provided with a sensor fixed on the fitting section of each developing, unit of a movable support member for detecting whether the developing unit is properly mounted or not, by which the problem of leaving a developing unit unmounted can be avoided since the detection by sensors is performed at the fitting sections of each developing unit. However, such detecting method can not deal with the case when the movement of the elevation method movable support member is unbalanced by fatigue of the balancer used with the support member. Furthermore, it invites a rise in manufacturing cost since the sensor has to be provided with each one of the developing units of the movable support member.

There is also a problem that the cord used for connecting the sensor with a device located outside the movable support member tends to be pulled about by the rotation of the movable support member. Especially in the case of the rotary method, the cord can not be pulled about since the movable support member is switched and moved in only one direction. Even in the case of the elevation method, it is not a small burden to pull about the cords of each one of the developing units. In order to deal with the problem, a conductive brush may be considered to be used. However, it causes manufacturing costs to be raised.

The present invention is, therefore, aimed at providing an image forming apparatus capable of solving all of the above-mentioned problems.

SUMMARY OF THE INVENTION

The main object of the present invention is to provide an image forming apparatus without having any problem inherent in the conventional type of apparatus by designing the apparatus to detect an operationally unbalanced state caused by leaving one or a plurality of developing units unmounted and the fatigue of a balancer with the passage of time with a judgment whether the movable support member is moved or not when the movable support member is unlocked at a predetermined position.

Another object of the present invention is to provide an image forming apparatus capable of judging the cause of an unbalanced operational movement whether it is originated from the state of an unmounted developing unit or the fatigue of a balancer by only detecting the direction of movement when the movement is detected in addition to the movement at the time when the movable support member is unlocked, wherein a plurality of developing units are changeably used in an elevation method movable support member.

A further object of the present invention is to provide an image forming apparatus preferably provided with every possible measure for use by making judgment on the cause of an unbalanced operational movement of a movable support member every time when a device is at an initial state.

These and other objects and features of the present invention will become more apparent from the following description taken in conjunction with the accompanying drawings which illustrate specific embodiments of the invention.

BRIEF DESCRIPTION OF THE DRAWINGS

It is to be noted that like members used in each embodiment are designated by like numerals, and repeated descriptions are omitted.

DESCRIPTION OF THE PREFERRED EMBODIMENT

Two representative embodiments of the present invention will now be described below with reference to accompanying drawings.

FIGS. 1 through 7 illustrate a first embodiment of the present invention which is applied to a color copying machine. This embodiment is designed to changeably use four developing units *7b*,*7c*,*7m* and *7y* in an elevation method.

Figure 1:
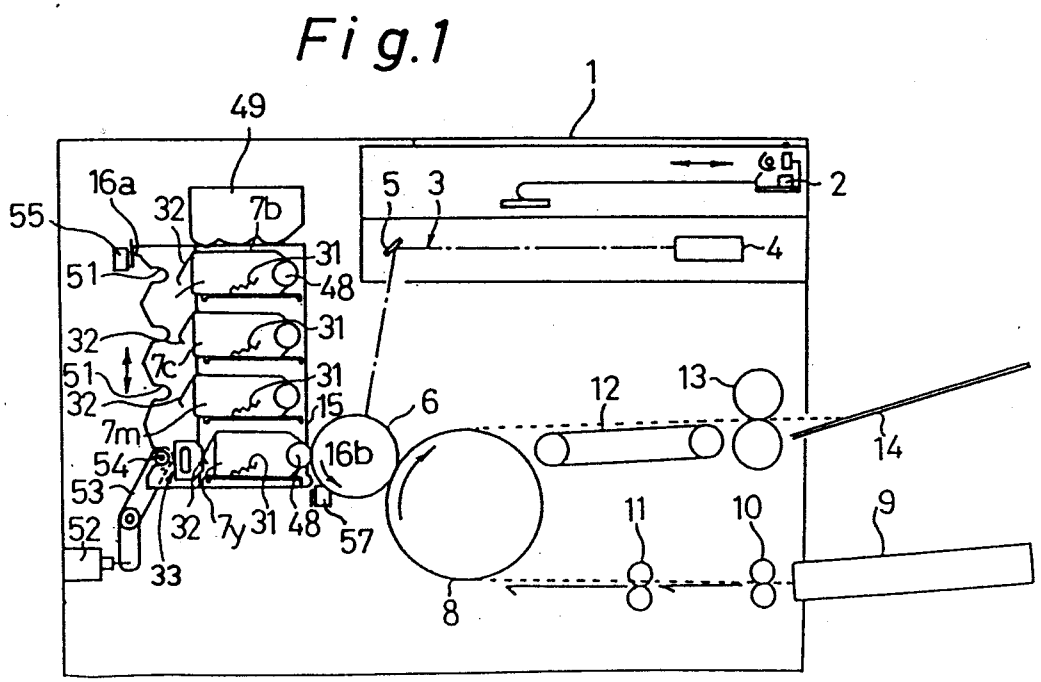
FIG. 1 is a schematic structural view showing a first embodiment of the present invention which is applied to a color copying machine.

FIG. 1 shows the whole schematic structure of a copying machine. A color image of an original placed on a platen glass 1 is read as color signals of three primary colors by a CCD line sensor 2. Each color signal is converted into four signals of Y (yellow), M (magenta), C (cyan) and Bk (black) by an image processing circuit and its output signal is transmitted to a laser optical system 3.

From a laser light generating device 4 in the laser optical system 3, laser light for forming images of each color corresponding to signals of the Y,M,C and Bk is irradiated. The laser light is then guided through a reflector 5 to a photoconductive drum 6 and irradiates the surface of the drum.

On the surface of the photoconductive drum 6 which rotates in the direction of the arrow in the figure, a latent image is formed by irradiation of the laser light. For the latent image formed corresponding to the signal Y, Yellow toner Y is supplied to the photoconductive drum 6 from a developing unit *7y* and an yellow toner image is formed on the photoconductive drum 6. In the same manner, each colored toner is supplied to the photoconductive drum 6 from M developing unit *7m*, C developing unit *7c*, Bk developing unit *7b* thereby forming magenta toner image, cyan toner image and black toner image respectively for the latent image formed corresponding to the signal M, signal C and signal Bk.

A sheet of copy paper fed from a paper cassette 9 and transported by transport rollers 10,11 is wrapped around a transfer drum 8 which rotates in the direction of the arrow in the figure. Onto the paper wrapped around the transfer drum 8, each colored toner image on the photoconductive drum 6 is successively transferred by rotation of the transfer drum for the required number of times. The toner images of each color being transferred are composed on the copy paper and a colored toner image is formed thereon. The copy paper on which a colored toner image is formed is separated from the transfer drum 8 and is then transported through a transfer belt 12 to a fixing roller 13 where the colored toner image is fixed and then discharged to a discharge tray 14.

Figure 2:
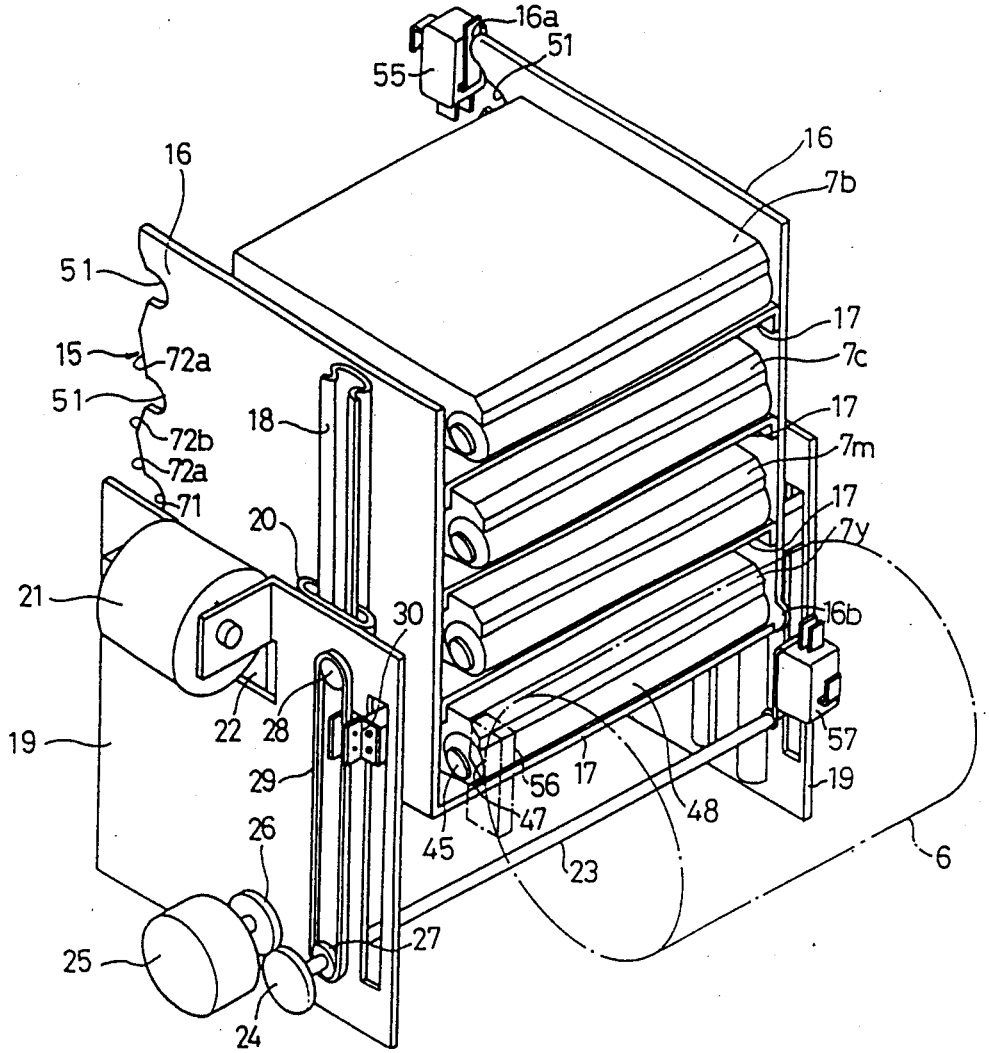
FIG. 2 is a perspective view of a developing device.

The M developing unit *7m*, Y developing unit *7y*, C developing unit *7c* and Bk developing unit *7b* are supported in this order by an elevation support member 15 starting from the uppermost to the lowermost of the support member in four stages. As shown in FIG. 2, the elevation support member 15 is provided with two sheets of sideboard 16,16 and four sheets of developing unit support board 17. On each one of the developing unit support boards 17, each developing unit *7m*, *7y*, *7c* and *7b* is placed, and they are movably supported and guided back and forth.

On the outer surface of the sideboard 16,16 of the elevation support member 15, rails 18 are mounted in the vertical direction. The rails 18 are fitted into rails 20 attached to the inner surface of a pair of stationary boards 19,19 fixed on the main body of the machine. The elevation support member 15 is vertically movably guided and supported by the stationary boards 19,19 in a fitting relation between the rails 18,20. A toner replenishing unit 49 is placed on the uppermost stage of the elevation support member 15.

A balancer 21 of constant force spiral spring is mounted on the stationary board 19, and the tip portion of a spring sheet 22 of the balancer 21 is attached to the sideboard 16 of the elevation support member 15. The balancer 21 which balances with the gross weight of the elevation support member 15 is used, and it is also arranged to always maintain a balanced state irrespective of any vertical position of the elevation support member 15. Although not shown in FIG. 2 the same balancer as mentioned above is mounted on the opposite stationary board 19.

Figure 10:
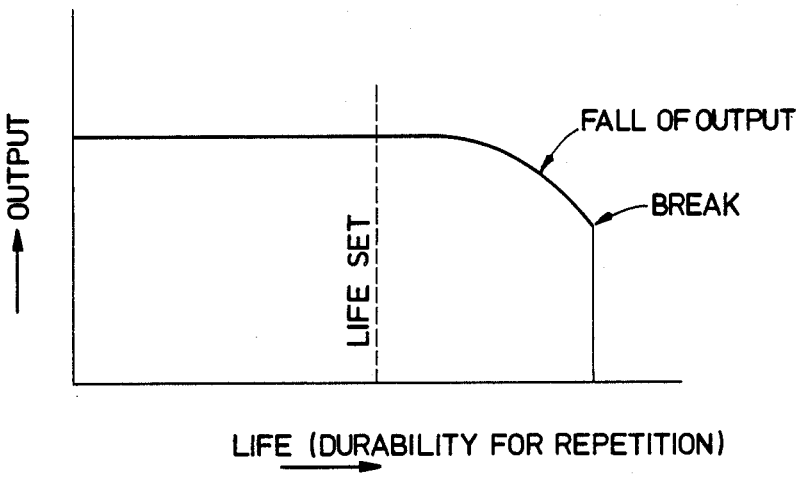
FIG. 10 is a graph showing a characteristic line of a fixed output balancer which works on an elevation support member.

The life of the balancer 21 is set corresponding to the repetition of expansion and contraction occurring with the movement of the elevation support member 15 as shown by broken line in FIG. 10. When the life reaches its limit, the balancer 21 has to be replaced with a new one, however, it is quite difficult to judge the timing of replacement.

A driving shaft 23 is hung at the lower portion between the stationary boards 19,19 and a gear 24 fixed to one end of the shaft is interlocked with a driving gear 26 of a DC motor 25. Adjacent to both ends of the driving shaft 23, sprockets 27 are fixed. At the positions above the sprockets 27, there are provided sub-sprockets 28 held on the stationary boards 19, and chains 29 are wound around between the sprockets 27 and 28. The chain 29 and the elevation support member 15 are connected with couplers 30. Thus, the elevation support member 15 is moved to a predetermined height of position by rotative control of the DC motor 25 from either lower or upper position. Accordingly, the height of position of the elevation support member 15 can be freely set, for instance, to position the Y developing unit *7y* which is at the lowermost stage to the height of developing location opposite to the photoconductive drum 6 or to position each developing unit *7m,7c,7b* at the height of developing location.

At the rear end of the frame of the elevation support member 15, notched portion 51 is formed for positioning. The notched portion 51 is provided opposite to each developing unit *7b,7c,7m* and *7y*. Behind the elevation support member 15, a lock lever 53 connected to a solenoid 52 is provided. The lock lever 53 is provided on its tip portion with a lock roller 54 which is connected or disconnected with the notched portion 51. The lock lever 53 is moved to the locked position by the solenoid 52 every time when each developing unit *7b,7c,7m* and *7y* is switched and moved to the height of developing location, wherein the lock roller 54 is engaged with the notched portion 51 opposite to a developing unit reached at the height of developing location, and the elevation support member 15 is locked. The lock lever 53 is also moved conversely to the unlocked position by the solenoid 52 when each developing unit *7b,7c,7m* and *7y* is switched and moved.

The home position of the elevation support member 15 is the position where the lowermost developing unit *7y* is positioned at the developing location as shown in FIGS. 1 and 2. Such a state is detected when a home position switch 55 is pushed by a protrusion 16*a* provided on a part of the sideboard 16.

Each developing unit *7b,7c,7m* and *7y* is biased backward by a spring 31 provided on each of the developing unit support boards 17 on which each one of the developing units is placed, and they are positioned at a predetermined rear position, i.e. the position where the latent image on the photoconductive drum 6 is not affected even if it is positioned at the height of developing location. At the back end portions of the developing units *7b,7c,7m* and *7y*, flat springs 32 which are bended in < shape are provided with their upper ends firmly fixed.

At the back of the elevation support member 15, a guide means 33 is provided to advance a developing unit reached at the height of developing location to the operating position. The guide means 33 is, therefore, positioned behind a developing unit which is at the developing location, for instance, behind the Y developing unit *7y* in FIG. 1. The developing unit at the operating position most closely approaches the photoconductive drum 6 sufficiently enough for the developer on a developing roll 48 to be supplied to the surface of the photoconductive drum 6.

Figure 3:
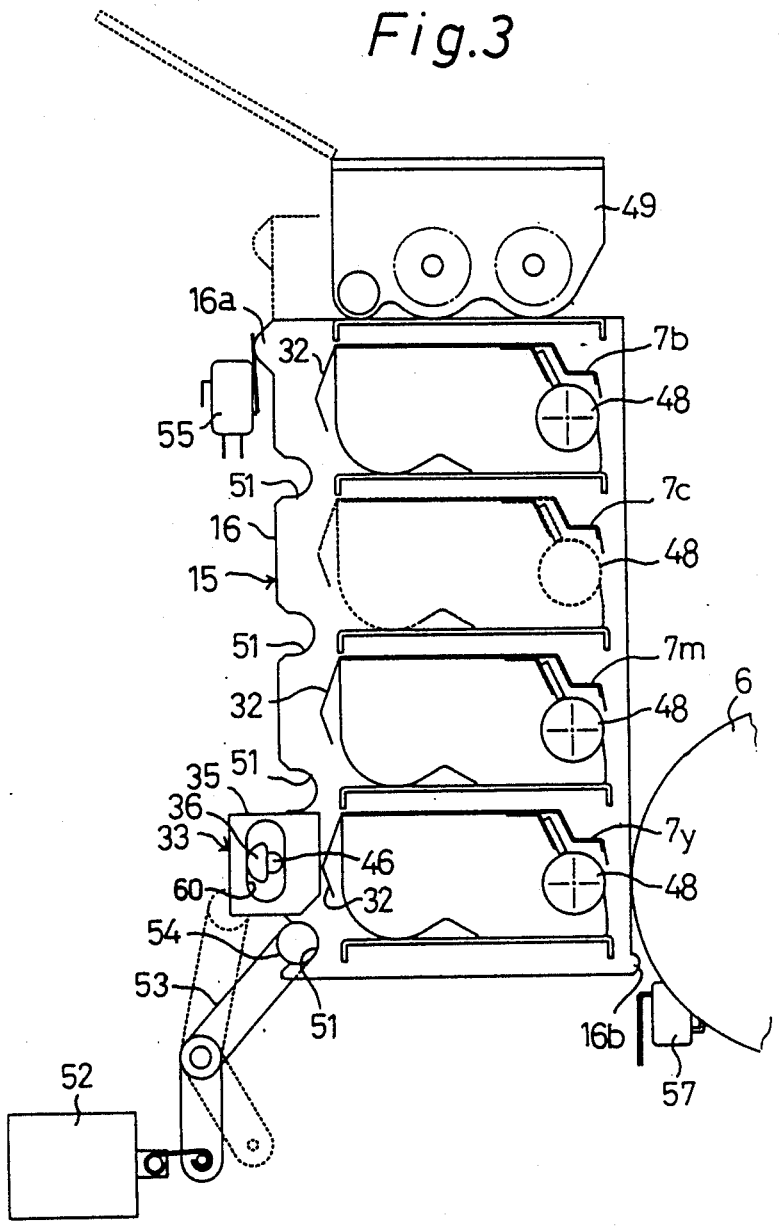
FIG. 3 is a side view showing the state when a developing device is locked at a home position in comparison with an unlocked state when a developing unit is left unmounted.
Figure 4:
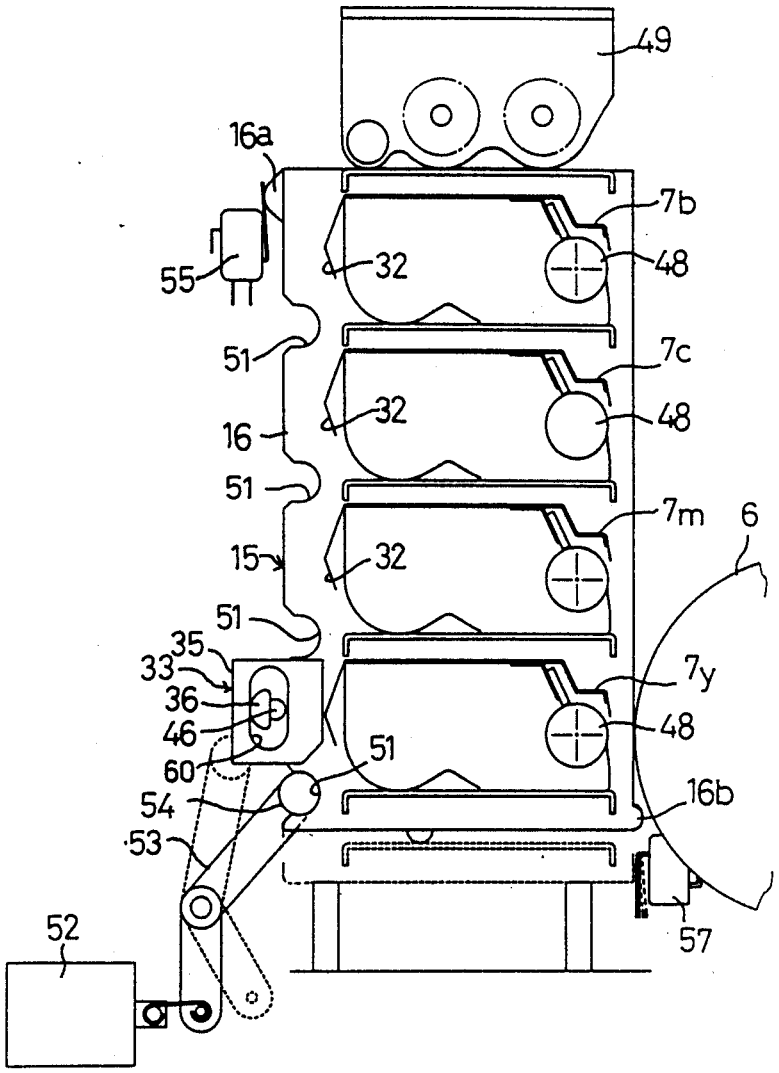
FIG. 4 is a side view showing the state when a developing unit is locked at a home position in comparison with an unlocked state when a balancer is in fatigue.
Figure 5:
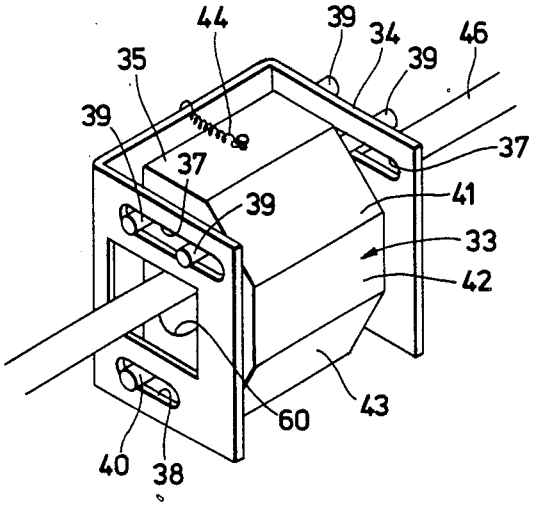
FIG. 5 is a perspective view illustrating a guide means which pushes out a developing unit moved to the developing location to the location of operation.

The guide means 33 is provided with, as shown in FIGS. 3 through 5, a stationary frame 34 fixed on the main body of a copying machine, a moving cam 35 movably supported and guided back and forth by the stationary frame 34, and an eccentric driver 36 for moving the moving cam 35 back and forth. At the upper and lower portions of sideboards of the stationary frame 34, there are formed guiding long grooves 37,38 in the horizontal direction, to which guide pins 39,40 protruded from side walls of the moving cam 35 are engaged. The moving cam 35 is thus guided and supported by the stationary frame 34.

The front of the moving cam 35 is successively formed by an inclined plane 41 at the upper portion, a vertical plane 42 at the middle portion and an inclined plane 43 at the lower portion. The moving cam 35 is provided with hollow portion 60 bored through laterally wherein the eccentric driver 36 is positioned. The moving cam 35 is biased backward by a spring 44 energized between the stationary frame 34 and is moved back and forth with rotation of the eccentric driver 36 since the front wall of the hollow portion 60 is pressed to contact the driver 36. The eccentric driver 36 is fixed to a cam driving shaft 46, and the cam driving shaft 46 is rotatively controlled by an unillustrated motor and clutch.

The upper inclined plane 41 of the moving cam 35 functions to forwardly guide any one of the developing units *7b,7c,7m* and *7y* which approaches the height of position for development to the photoconductive drum 6 gradually with the descent movement of the elevation support member 15.

The lower inclined plane 43 of the moving cam 35 functions to forwardly guide any one of the developing units *7b,7c,7m* and *7y* which approaches the height of position for development to the photoconductive drum 6 gradually with the ascent movement of the elevation support member 15.

The eccentric driver 36 functions to advance any one of the developing units *7b,7c,7m* and *7y* which reaches the height of position for development against the spring 4 and to return the developing unit to the rear position by energy of the spring 44.

The positioning of the developing units *7b,7c,7m* and *7y* at the forward position for development is carried out by an engagement of developing roll bearings 45 of the developing units *7b,7c,7m* and *7y* with the V groove 47 of a positioning plate 56 provided on both sides of the photoconductive drum 6. When the forward position is thus decided, the developing roll 48 and the photoconductive drum 6 most closely approach each other to be ready for supplying toner to the position of an electrostatic latent image on the photoconductive drum 6 from the developing units *7b,7c,7m* and *7y*.

The operation of a copying machine for color copying will now be described below.

Before the start of copying operation, the elevation support member 15 is positioned at the uppermost position as shown in FIGS. 1 through 4, and the Y developing unit *7y* at the lowermost stage is positioned at the height of developing location, which is the home position of the elevation support member 15. At this time, the Y developing unit *7y* is at a retreated position and is located behind the photoconductive drum 6.

With a start of copying operation, latent images corresponding to each signal Y,M,C and Bk are successively formed on the photoconductive drum 6. Every time that an electrostatic latent image is formed on the photoconductive drum 6, one of the developing units *7b,7c,7m* and *7y* is moved to the height of developing location by the DC motor 25 corresponding to each image forming signal of Y,M,C and Bk.

When a developing unit is moved, the lock lever 53 is moved to a lock released position illustrated by the broken line in FIGS. 3 and 4 by the solenoid 52, by which ascending and descending movement of the elevation support member 15 is not obstructed. With this action, cam driving shaft 46 is rotated, and guide means 33 is retreated from the path of ascending and descending movement of each developing unit *7b,7c,7m* and *7y* by eccentric driving member 36 provided as shown in FIGS. 3 and 4. Accordingly, all the developing units 7b,7c,7m and 7y are at the retreated positions and are moved to a required position without obstructing the photoconductive drum 6.

When each developing unit 7b,7c,7m and 7y reaches the height of development, the lock lever 53 is moved by the solenoid 52 to the lock position shown by a solid line and the elevation support member 15 is also locked, while the guide means 33 is actuated by the eccentric driving member 36 to contact any one of the developing units that has reached the height of developing location with the photoconductive drum 6 with a positioning plate 56. An electrostatic latent image being formed on the photoconductive drum 6 is thus developed by a predetermined colored toner. Each colored toner image developed on the photoconductive drum 6 is transferred onto a copy paper on the transfer drum 8 every time when the development is performed superimposing one on top of another, and a colored copy composed of each colored toner image is obtained.

In case when the final development is carried out by the Y developing unit 7y in each one of the above-described copying operations, the elevation support member 15 is positioned at the home position, however, in other cases, the lock lever 53 is moved to the lock position by the solenoid 52 after the elevation support member is returned to the home position so that the elevation support member 15 is locked at the home position. This locking action is carried out when the elevation support member 15 is detected at the home position by the switch 55.

When any one of the developing units 7b,7c,7m and 7y is temporarily detached or replaced with another unit for exchange of developers, sealing materials and bearings, it may happen that one forgets to mount, for instance, a developing unit 7c as shown by broken line in FIG. 3 thereby causing a problem that the force of action of the balancer 21 becomes larger than the gross weight of the elevation support member 15. There is also a problem that, even if the developing units are properly mounted, when a spring type balancer is fatigued with the passage of time, the force of action of the balancer 21 is lower than the gross weight of the elevation support member 15.

Figure 6:
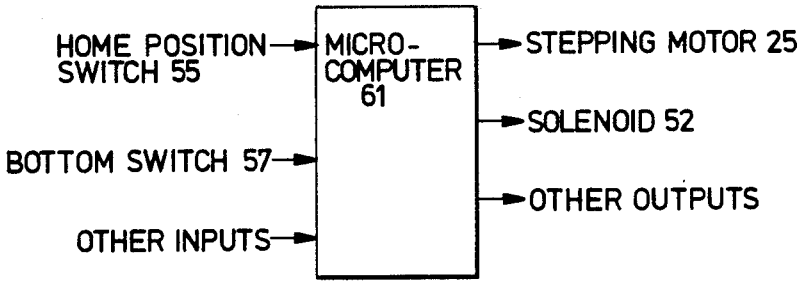
FIG. 6 is a block diagram of a control circuit.
Figure 7:
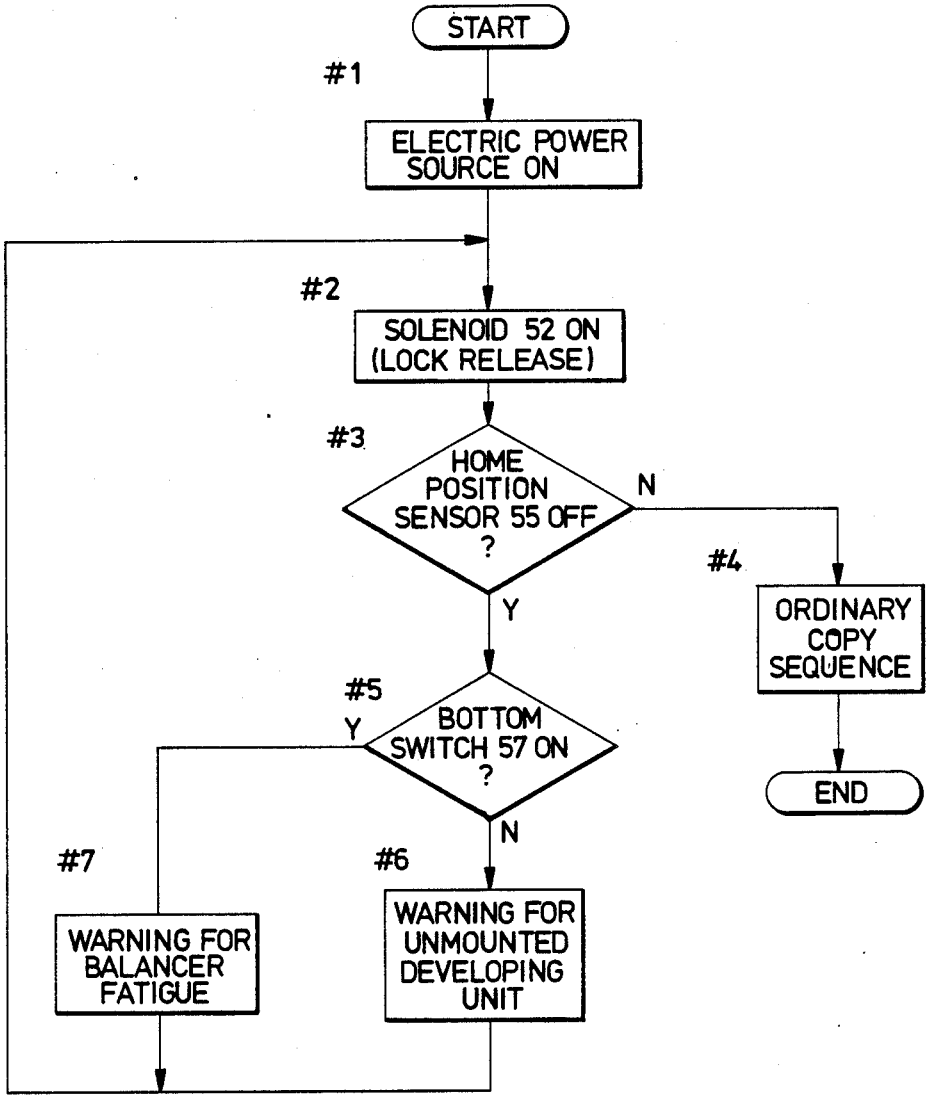
FIG. 7 is a flow chart of essential operational control circuit.

In order to deal with the problems, there is provided a switch 57 which is pushed by the protrusion 16b of the sideboard 16 when the elevation support member 15 is descended from the home position as shown in FIGS. 1 and 4. By connecting the switch 57 as well as the home position switch 55 to a microcomputer 61 as illustrated in FIG. 6, it becomes possible to deal with the above-mentioned problems with operational control of a copying machine as shown by a flow chart in FIG. 7, which will now be described.

After the electric power source is turned on, the lock lever 53 is temporarily moved by the solenoid 52 to the lock released position and the locked state of the elevation support member 15 at the home position is release (step #1, #2). The elevation support member 15 locked at the home position thus becomes free, and if a developing unit is left unmounted, the elevation support member 15 is ascended as shown by the broken line in FIG. 3 because of an unbalanced state with the balancer 21. Then, judgment is made whether the home position switch 55 is detecting the elevation support member 15 (step #3). At this stage, if the switch 55 detects the home position of the elevation support member 15, the program proceeds to step #4 for executing an ordinary copying sequence since the elevation support member 15 and the balancer 21 are well balanced.

If the switch 55 does not detect the home position of the elevation support member 15, the elevation support member 15 and the balancer 21 are not balanced. However, the cause of the unbalanced state has to be judged since there are cases when a developing unit is left unmounted or it originated from fatigue of the balancer 21 with the passage of time.

This judgment is made by the bottom switch 57 provided a little below the home position of the elevation support member 15 whether it is turned on or not (step #5). In other words, in case when a developing unit is left unmounted, the elevation support member 15 is moved upward since the gross weight of the support member 15 is smaller than the force of action of the balancer 21 and does not push the switch 57. When the switch 57 is turned off, it is therefore judged that a developing unit is left unmounted. In case when the balancer 21 is fatigued, the elevation support member 15 is moved downward since the gross weight of the support member 15 exceeds the force of action of the balancer 21 and pushes down the switch 57. When the switch 57 is turned on, it is therefore judged that the balancer 21 is fatigued.

In case when a developing unit is left unmounted, warning is given that the developing unit is not mounted (step #6), and in case of fatigue of the balancer 21, warning is given that the balancer 21 is fatigued (step #7), and then the program returns to step #2. Necessary procedure corresponding to the cause of trouble is thus carried out, and thereafter, ordinary copying sequence is executed.

Figure 8:
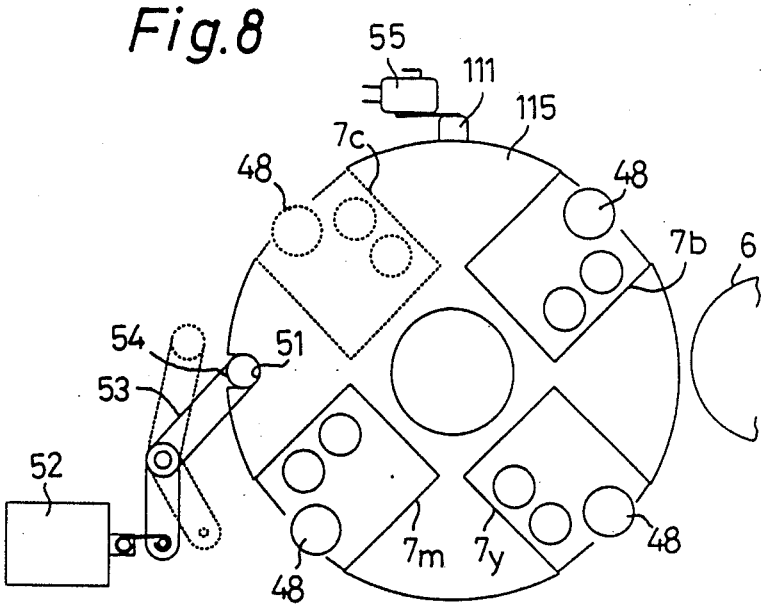
FIG. 8 is a side view showing a locked state of a developing unit at a home position in a second embodiment of the present invention.
Figure 9:
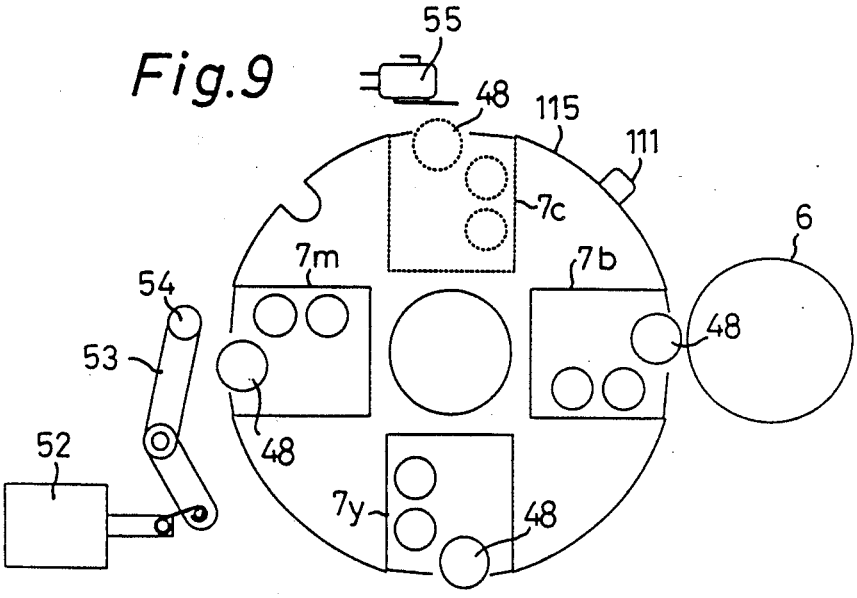
FIG. 9 is a side view showing the state of movement when a developing unit is left unmounted and a developing device is unlocked.

A second embodiment of the present invention as shown in FIGS. 8 and 9 illustrate a case wherein each developing unit 7b,7c,7m and 7y supported on a rotary support member 115 is rotatively switched for use in a rotary method. Each developing unit 7b,7c,7m and 7y is disposed spaced apart on the same circumference around the axis line of rotation of the rotary support member 115 and supported by the rotary support member 115. Accordingly, the rotary support member 115 is well balanced around the rotative axis line. By rotation of the rotary support member 115, each developing unit 7b,7c,7m and 7y is switched and moved to the developing location opposite to a photoreceptor 6 for selective use.

The position of the rotary support member 115 illustrated in FIG. 8 is the home position of the rotary support member. The rotary support member 115 is locked at the home, position by engagement of a notched portion 51 provided on a part of the circumference of the rotary support member with a lock roller 54 of a lock lever 53. The lock lever 53 is switched and operated by a solenoid 52 between a locked position shown by the solid line and an unlocked position shown by the broken line just in the same manner as that of the first embodiment of the present invention above-mentioned.

The home position of the rotary support member 115 is detected when a protrusion 111 provided on the circumference of the support member presses a home position switch 55 just like the first embodiment of the present invention mentioned. The rotary support member is rotatively driven smoothly since it is well balanced by its own weight balance. Accordingly, such a balancer as disclosed in the first embodiment of the present invention is not required and there is no fear of unbalanced state caused by fatigue of the balancer.

However, for instance, when a developing unit *7c* shown by the broken line in FIG. 8 is left unmounted, the center of gravity of the rotary support member 115 comes out of the center of rotation of the support member 115 and irrational factor is given to the driving means because of an effect of eccentric gravity. In this embodiment, every time when a copying machine starts its operation, locked state of the home position of the rotary support member 115 is released by the lock lever 53, and thereafter, judgment is made whether the home position of the rotary support member is detected or not by the switch 55.

When a developing unit is left unmounted as shown in FIG., 8, and if the locking at the home position of rotary support member 115 is released, the rotary member is rotatively moved spontaneously until the eccentric gravity stabilizes as shown in FIG. 9, by which judgment can be made that a developing unit is left unmounted since the switch 55 does not detect the home position of the rotary support member 115.

When developing units are properly mounted, even the locking at the home position of the rotary support member 115 is released, the support member stays at the home position without having any spontaneous rotative movement since it is well balanced, and the home position is detected by the switch 55.

According to the present invention, in case when a movable support member provided with a plurality of developing units in a well-balanced state loses its balance for some reason, it is designed to automatically detect the cause of troubles so that operational incapability under an unbalanced state or inconveniences by breakage of cogs of a gear in the driving system can be prevented.

Moreover, such a detection can advantageously be made in common use of the sensor already provided for detecting the home position of the movable support member.

When an unbalanced state is caused only by unmounted developing unit, the detection that a developing unit is not mounted can be made with a sensor provided at a predetermined position without having the problem of pulling about a cord.

In case when an unbalanced state is caused only by the fatigue of a balancer used for balancing with an elevation support member which changeably and movably supports a plurality of developing units, the detection can be made that the balancer is fatigued.

When an unbalanced state is caused by either an unmounted developing unit or the fatigue of a balancer, a detection can be made by adding a new sensor which is capable of detecting whether the cause of trouble is originated from the unmounted developing unit or the fatigue of the balancer. By this sensor alone, the fatigue of a balancer can be detected.

As shown in the first embodiment of the present invention, when an electric power source is turned on, the detection is automatically carried out every time when a device such as a copying machine gets ready for initiating its operation so that the copying machine is able to surely avoid such a disadvantageous state that a developing unit is left unmounted or a balancer is fatigued before the copying machine starts its operation.

As a timing for properly carrying out the automatic detection when the machine is at an initial state, it may also make use of a timing when an auto-shut timer is stopped after the machine has finished its action or when all-clear key is operated to return the machine to a normal state.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus having a plurality of developing units which are accommodating different colored developers for developing an electrostatic latent image on an image supporting member, comprising:

a movable support member for attachably and detachably supporting a plurality of developing units wherein the developing units are moved upwardly and downwardly;

a balance means for balancing with the movable support member provided with a plurality of developing units wherein a balanced state is maintained at any moving position of the movable support member;

a lock means capable of engaging with an engaging portion provided on the movable support member to lock the movable support member at a desired position; and a first detection means for detecting whether the movable support member moves or not from the position it was locked when the movable support member is released from a locked state by the lock means.

2. An image forming apparatus as defined in claim 1, wherein the movable support member moves upwardly and downwardly in the vertical direction.

3. An image forming apparatus as defined in claim 1, wherein the balance means is a balancer of constant force spiral spring.

4. An image forming apparatus as defined in claim 1, wherein the lock means locks the movable support member at any position where each developing unit is positioned at a developing location including a home position of the movable support member, the apparatus further including a control means for locking the lock means the movable support member at the home position by returning it to the home position after an image forming operation is carried out.

5. An image forming apparatus as defined in claim 4, wherein the first detection means detects whether movable support member moves or not from the home position where it was locked.

6. An image forming apparatus as defined in claim 5, wherein the home position of the movable support member is the position where a developing unit which is given the first order of priority for a color image forming apparatus is positioned at the developing location.

7. An image forming apparatus as defined in claim 1, further including a second detection means for detecting whether or not the movable support member moves downward from the position where it was locked when the locked state is released by the lock means and a judging means for judging whether a developing unit is left unmounted or the balance means is fatigued by the result whether the second detection means detects downward movement of the movable support member when the first detection means detects the movement of the movable support member.

8. An image forming apparatus having a plurality of developing units which are accommodating different colored developers for developing an electrostatic latent image on an image supporting member, comprising:

a movable support member for attachably and detachably supporting a plurality of developing units wherein the developing units are moved upwardly and downwardly;

a balance means for balancing with the movable support member provided with a plurality of developing units wherein a balanced state is maintained at any moving position of the movable support member;

a lock means capable of engaging with an engaging portion provided on the movable support member to lock the movable support member at a desired position;

a first detection means for detecting whether the movable support member moves or not from the position it was locked when the movable support member is released from a locked state by the lock means; and a first control means for unlocking the movable support member by the lock means when the apparatus is returned to an initial state and actuates the first detection means.

9. An image forming apparats as defined in claim 8, wherein the movable support member moves upwardly and downwardly in the vertical direction.

10. An image forming apparatus as defined in claim 8, wherein the balance means is a balancer of constant force spiral spring.

11. An image forming apparatus as defined in claim 8, wherein the lock means locks the movable support member at any position where each developing unit is positioned at a developing location including a home position of the movable support member, the apparatus further including a second control means for locking the movable support member at the home position by the lock means after an image forming operation is carried out.

12. An image forming apparatus as defined in claim 11, wherein the first detection means detects whether or not the movable support member moves from the home position where it was locked.

13. An image forming apparatus as defined in claim 12, wherein the home position of the movable support member is the position where a developing unit which is given the first order of priority for a color image forming operation is positioned at the developing location.

14. An image forming apparatus as defined in claim 8, further including a second detection means for detecting whether or not the movable support member moves downward from the position where it was locked when the locked state is released by the lock means and a judging means for judging whether the developing unit is left unmounted or the balance means is fatigued by the result of whether the second detection means detects downward movement of the movable support member when the first detection means detects the movement of the movable support member, wherein the first control means together with the first detection means actuates the second detection means and the judging means.

15. An image forming apparatus having a plurality of developing units which are accommodating different colored developers for developing an electrostatic latent image on an image supporting member, comprising:

a rotary support member for attachably and detachably supporting a plurality of developing units which maintain mutual balance on a common circle orbit by its own rotation and moves the developing units along the circular orbit;

a lock means capable of engaging with an engaging portion provided on the rotary support member to lock the movable support member at a desired position excepting at least either one of the positions where the rotary support member is positioned at a developing location; and a detection means for detecting whether or not the rotary support member moves from the position it was locked when the rotary support member is unlocked by the lock means.

16. An image forming apparatus as defined in claim 15, wherein the lock means locks the movable support member at the home position, the apparatus further including a control means for locking the movable support member by the lock means at the home position after an image forming operation is carried out.

17. An image forming apparatus as defined in claim 15, wherein a home position of the movable support member is the position where a developing unit which is given the first order of priority for color image forming operation is positioned at the developing location.

18. An image forming apparatus having a plurality of developing units which are accommodating different colored developers for developing an electrostatic latent image on an image supporting member, comprising:

a rotary support member for attachably and detachably supporting a plurality of developing units which maintain mutual balance on a common circular orbit by its own rotation and moves the developing units along the circular orbit;

a lock means capable of engaging with an engaging portion provided on the rotary support member to lock the movable support member at a desired position excepting at least either one of the positions where the rotary support member is positioned at a developing location;

a detection means for detecting whether the rotary support member moves from the position it was locked when the rotary support member is unlocked by the lock means; and a control means for actuating the detection means by unlocking an apparatus with the lock means when it is set at an initial state.

19. An image forming apparatus as defined in claim 18, wherein the lock means locks the movable support member at a home position, and wherein said apparatus further includes a control means for locking the movable support member by the lock means at the home position by returning the movable support member to the home position after an image forming operation is carried out.

20. An image forming apparatus as defined in claim 19, wherein the home position of the movable support member is the position where a developing unit which is given the first order of priority for color image forming operation is positioned at the developing location.

21. An image forming apparatus having a plurality of developing units which are accommodating different colored developers for developing an electrostatic latent image on an image supporting member, comprising:

means for supporting said developer units in a regulated orientation, said support means including a pair of support members for supporting said developing units at the opposite sides thereof and two rails mounted between said support members and stationary plates so as to movable hold the support members in the vertical direction;

drive means for vertically moving said support means;

a balance means for balancing with the support means provided with a plurality of developing units wherein a balanced state is maintained at any moving position of the support means; and a detection means for detecting whether or not the support means moves from a home position where the support means has to be positioned at an initial state after the apparatus is set to an initial state.

* * * * *

UNITED STATES PATENT AND TRADEMARK OFFICE

CERTIFICATE OF CORRECTION

PATENT NO. : 4,939,548

DATED : July 3, 1990

INVENTOR(S) : Takanobu Yamada, et al.

It is certified that error appears in the above-identified patent and that said Letters Patent is hereby corrected as shown below:

In col. 2, line 4, change "to damage" to --damage to--.

In col. 2, line 8, delete "," (comma).

In col. 6, line 28, change "4" to --44--.

In col. 7, line 58, change "release" to --released--.

In col. 8, line 51, delete "," (comma).

In col. 10, line 45 (claim 4, line 6), after "locking", insert --by--.

In col. 10, line 50 (claim 5, line 2), after "whether", insert --the--.

In col. 10, line 57 (claim 6, line 5), change "apparatus" to --operation--.

In col. 11, line 27 (claim 9, line 1), change "apparats" to --apparatus--.

In col. 12, line 8 (claim 15, line 12), change "movable" to --rotary--.

In col. 12, line 17 (claim 16, line 2), change "movable" to --rotary--.

UNITED STATES PATENT AND TRADEMARK OFFICE

CERTIFICATE OF CORRECTION

PATENT NO. : 4,939,548

DATED : July 3, 1990

INVENTOR(S) : Takanobu Yamada, et al.

It is certified that error appears in the above-identified patent and that said Letters Patent is hereby corrected as shown below:

In col. 12, line 19 (claim 16, line 4), change "movable" to --rotary--.

In col. 12, line 20 (claim 16, line 5), after "position", insert --by returning the rotary support member to the home position--.

In col. 12, line 23 (claim 17, line 2), change "movable" to --rotary--.

In col. 12, line 38 (claim 18, line 12), change "movable" to --rotary--.

In col. 12, line 43 (claim 18, line 17), after "moves", insert --or not--.

In col. 12, line 50 (claim 19, line 2), change "movable" to --rotary--.

In col. 12, line 52 and 53 (claim 19, lines 4 and 5), change "movable" to --rotary--.

In col. 12, line 54 (claim 19, line 6), change "movable" to --rotary--.

In col. 12, line 58 (claim 20, line 2), change "movable" to --rotary--.

UNITED STATES PATENT AND TRADEMARK OFFICE

CERTIFICATE OF CORRECTION

PATENT NO. : 4,939,548

DATED : July 3, 1990

INVENTOR(S) : Takanobu Yamada, et al

It is certified that error appears in the above-identified patent and that said Letters Patent is hereby corrected as shown below:

In col. 13, line 3 (claim 21, line 10), change "movable" to --movably--.

Signed and Sealed this

Twenty-ninth Day of October, 1991

*Attest:*

HARRY F. MANBECK, JR.

*Attesting Officer*

*Commissioner of Patents and Trademarks*